US005725463A

United States Patent [19]

Colonello et al.

[11] Patent Number: 5,725,463

[45] Date of Patent: Mar. 10, 1998

[54] ABDOMINAL EXERCISE DEVICE

[75] Inventors: Dennis J. Colonello, Studio City, Calif.; Robert R. Schnabel, Jr., Navarre, Ohio; John R. Collis, Minneapolis, Minn.

[73] Assignee: Fitness Quest, Inc., Canton, Ohio

[21] Appl. No.: 664,222

[22] Filed: Jun. 11, 1996

Related U.S. Application Data

[60] Provisional application No. 60/001,175, Jul. 14, 1995.

[51] Int. Cl.[6] ..... A63B 23/02

[52] U.S. Cl. ..... 482/140; 482/131; 482/139; 482/908

[58] Field of Search ..... 482/10, 92, 95, 482/117, 121–123, 130–137, 139, 140, 142, 148, 908

[56] References Cited

U.S. PATENT DOCUMENTS

| | | | |
|---|---|---|---|
| 1,244,371 | 10/1917 | Reynolds . | |
| 1,911,572 | 5/1933 | Hulander et al. . | |
| 2,429,939 | 10/1947 | Masterson et al. . | |
| 2,446,275 | 8/1948 | Glasin . | |
| 2,475,289 | 7/1949 | MacGregor . | |
| 2,563,407 | 8/1951 | Haims . | |
| 2,722,967 | 11/1955 | Reinholz . | |
| 3,591,173 | 7/1971 | Cossman . | |
| 4,183,520 | 1/1980 | Chase . | |
| 4,241,949 | 12/1980 | Parker . | |
| 4,307,880 | 12/1981 | Abram . | |
| 4,314,697 | 2/1982 | Brumfield et al. . | |
| 4,367,870 | 1/1983 | Birch . | |
| 4,405,128 | 9/1983 | Mclaughlin et al. . | |
| 4,489,936 | 12/1984 | Dal Monte . | |
| 4,582,319 | 4/1986 | Luna . | |
| 4,729,562 | 3/1988 | Pipasik . | |
| 4,752,067 | 6/1988 | Colonello | 482/140 |
| 4,863,158 | 9/1989 | Tassone . | |
| 4,902,003 | 2/1990 | Buoni . | |
| 5,033,742 | 7/1991 | Johnson et al. | 482/140 |
| 5,100,130 | 3/1992 | Shoebrooks . | |
| 5,122,107 | 6/1992 | Gardner . | |
| 5,125,650 | 6/1992 | Paris . | |
| 5,215,511 | 6/1993 | Cheng | 482/133 |
| 5,256,126 | 10/1993 | Grotstein . | |
| 5,290,209 | 3/1994 | Wilkinson | 482/96 |
| 5,300,005 | 4/1994 | Wang . | |
| 5,346,447 | 9/1994 | Stearns . | |
| 5,393,280 | 2/1995 | Haviv | 482/117 |
| 5,441,473 | 8/1995 | Safani et al. . | |
| 5,492,520 | 2/1996 | Brown . | |
| 5,545,114 | 8/1996 | Gvoich | 482/140 |

FOREIGN PATENT DOCUMENTS

| | | | |
|---|---|---|---|
| 2239262 | 2/1975 | France | 482/117 |
| 1903502 | 8/1970 | Germany | 482/131 |

*Primary Examiner*—Jeanne M. Clark
*Attorney, Agent, or Firm*—Sand & Sebolt

[57] ABSTRACT

An abdominal exercise device to assist in exercising all three abdominal muscles includes a platform which is placed on a flat supporting surface. A substantially U-shaped body cage is pivotally mounted on the platform and extends outwardly therefrom and includes a U-shaped neck and head support portion and a pair of platform connecting portions adjustable connected thereto. A padded cushion mounted on the support portion supports the head of the user. A pair of pivot members pivotally connect the body cage to the platform. Each pivot member includes a cylindrical portion for pivotally rotatably mounting the body cage to side walls of the platform, and a semispherical portion which connects to free ends of the body cage. A user reclines on the platform and grasps the body cage and performs a sit-up type of motion with the body cage ensuring a full range of motion in the proper plane of movement to maximally recruit the abdominal muscles.

15 Claims, 6 Drawing Sheets

FIG-12
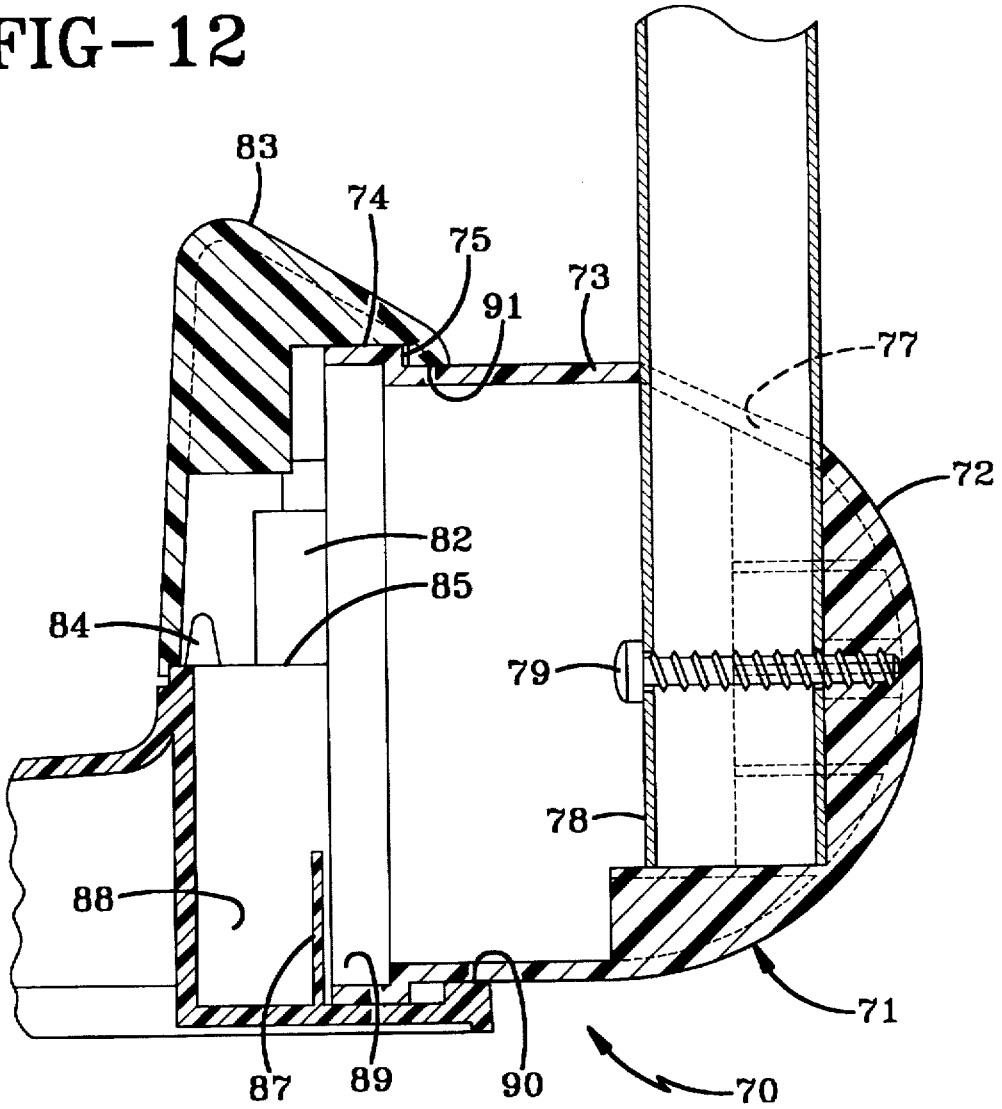
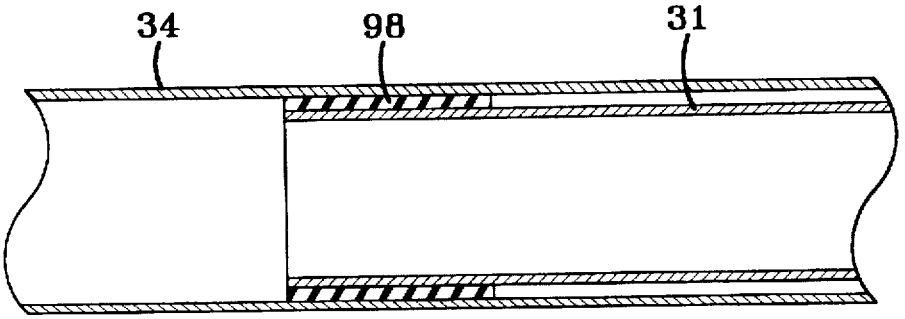
FIG-13

ABDOMINAL EXERCISE DEVICE

CROSS REFERENCE TO RELATED APPLICATION

This application is a standard application of provisional application Ser. No. 60/001,175 filed Jul. 14, 1995.

BACKGROUND OF THE INVENTION

TECHNICAL FIELD

The invention relates to an exercise device. More particularly, the invention relates to an abdominal exercise device. Even more particularly, the invention relates to an exercise device which positions the body so as to safely and effectively exercise all three of the abdominal muscles and provide support and protection to the sensitive facet joints and discs of the cervical spine.

BACKGROUND INFORMATION

Those skilled in the art of exercise generally accept that for an exercise device to be effective the device must provide, or preferably obligate, a body movement in a plane or planes which effectively recruit the muscles of the body part to be exercised. The device must permit a full range of motion of the body part to be exercised so as to effectively exercise the desired muscles throughout their entire length, and it must provide a variable resistance so as to progressively challenge the muscles and thereby strengthen and tone the desired muscles specific to the exercise.

Conventionally, a sit-up exercise is performed with the user's hands clasped behind the neck to prevent hyperextension of the neck and thus impingement of the sensitive cervical spine facet joints. However, with the hands clasped behind the user's neck there is a tendency for the neck to be hyperflexed by the pulling forces of the user's arms. Hyperflexion of the neck increases the loading on the cervical spine discs predisposing the discs to excessive compression strain and thereby increasing the potential for disc rupture and herniation. Furthermore, hyperflexion of the neck places a long axis traction stress to the posterior cervical musculature and may result in muscular strain or sprain.

Many prior art devices have been developed which may prevent hyperflexion of the neck while performing sit-up exercises. U.S. Pat. No. 5,100,130 shows a device which includes a flexible board of a fixed length and width. The user lies down on the flexible board while performing the abdominal exercises. The board supports the user's head, neck and back during use of the device.

U.S. Pat. No. 4,863,158 shows another sit-up or abdominal exercise device which uses resistance weights to progressively challenge the muscles while avoiding lower back stresses during the sit-up movement.

U.S. Pat. No. 5,346,447 shows a device which utilizes the vertically downward weight of the user to provide resistance during the exercise. An adjustable pivot point and a roller ball allow the resistance to be varied.

U.S. Pat. No. 4,405,128 shows another type of exercise apparatus for performing sit-ups, which uses a complicated arrangement of levers and weights, and an elaborate platform system required to support the exerciser's body when performing the exercise.

U.S. Pat. No. 4,314,697 shows a simple exercise device for performing various exercises, which includes a wedge-shaped base over which the user's legs extend when performing exercises, together with a spring to provide resistance when performing the exercise.

U.S. Pat. No. 4,489,936 shows another exercise device in which the user lies on an elongated board, and by pressing on articulated levers, will raise the board and the user's weight for performing various exercises, whereby the user's weight provides the resistance to the device.

Although these and other prior art abdominal exercise devices are presumably adequate for the purpose for which they were intended, the present invention improves upon some of the drawbacks of these devices, such as the large amount of space that is required to both use and store the device. Also, many of the prior devices are bulky, heavy and expensive for the ordinary home user. Also, in order to progressively increase or decrease the resistance the user must stop during his workout and adjust the machine.

Thus, the need exists for an abdominal exercise device which obligates a body movement in a plane or planes which effectively recruit the muscles of the body part to be exercised; which permits a full range of motion of the body part so as to thereby effectively exercise the desired muscles throughout their entire length; which provides a simple adjustment mechanism to vary the resistance and to progressively challenge the muscles; which provides neck and lower back support and protects the sensitive facet joints and discs of the cervical spine; which is compact in size both during use and storage; and which is relatively inexpensive to manufacture, and easy to ship, and assemble.

SUMMARY OF THE INVENTION

Objectives of the present invention include providing an exercise device which safely and effectively isolates the abdominus rectus and the internal and external oblique muscles.

Another objective of the invention is to provide such a device which permits a full range of motion while specifically anchoring the muscle origins at the rib cage and preventing muscles of the upper torso from assisting in the exercise.

A still further objective of the invention is to provide such an exercise device which provides neck and lower back support and eliminates cheating by creating momentum which reduces the demand on the abdominal musculature.

Another objective of the invention is to provide such a device which permits progressive resistance by varying the placement of the hands along the length of an upper body cage.

Still another objective of the invention is to provide such a device which supports and protects the sensitive facet joints and discs of the cervical spine.

Another objective of the invention is to provide such a device which is easily adjustable to allow operation by users of different upper body lengths while still providing neck support and the full effects of the exercise being performed.

A further objective of the invention is to provide such a device which is lightweight, compact and easily collapsible allowing the device to be used and stored in a small amount of space.

A still further objective of the invention is to provide such a device which is constructed of a lightweight tubing, which is relatively inexpensive to manufacture and ship, yet provides a safe and sturdy exercise device.

The exercise device of the present invention accomplishes these objectives by obligating a body movement similar to that of a "sit-up" and recruits the upper and lower fibers of the abdominus rectus and internal and external oblique muscles. The exercise device is adjustable to fit the body dimensions of users of various sizes and thus ensure a full range of motion of the exercise in an ideal plane of movement so as to maximally recruit the abdominal muscles. The device also provides for a plurality of hand grasp positions whereby the user may vary his hand position to progressively increase or decrease the resistance to the exercise.

These objectives and advantages are further obtained by the exercise device of the present invention the general nature of which may be stated as including a generally flat platform which is adapted to be placed on a support surface for supporting the lower torso of a user; a body cage for grasping by a user and providing head and neck support for the user during use of the device; and pivot means for pivotally attaching the body cage to the sides of the platform, said platform remaining in a fixed position on the support surface during pivotal movement of the body cage.

BRIEF DESCRIPTION OF THE DRAWINGS

Preferred embodiments of the invention, illustrative of the best mode in which applicants have contemplated applying the principles, are set forth in the following description and are shown in the drawings and are particularly and distinctly pointed out and set forth in the appended claims.

FIG. 12 is a sectional view showing the mounting of the pivot ball within the socket of FIG. 11; and FIG. 13 is an enlarged fragmentary sectional view showing the slidable connection between the components of the body cage portion of the device shown particularly in FIGS. 1–4.

Similar numbers refer to similar parts throughout the drawings.

DESCRIPTION OF THE PREFERRED EMBODIMENT

Figure 1:
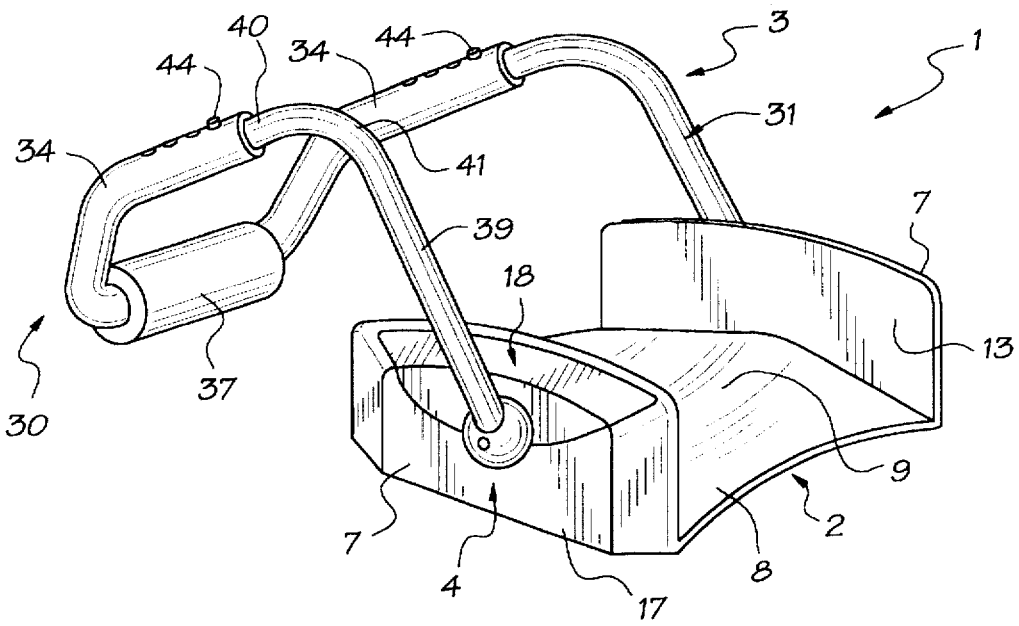
FIG. 1 is a perspective view of the exercise device of the present invention.
Figure 2:
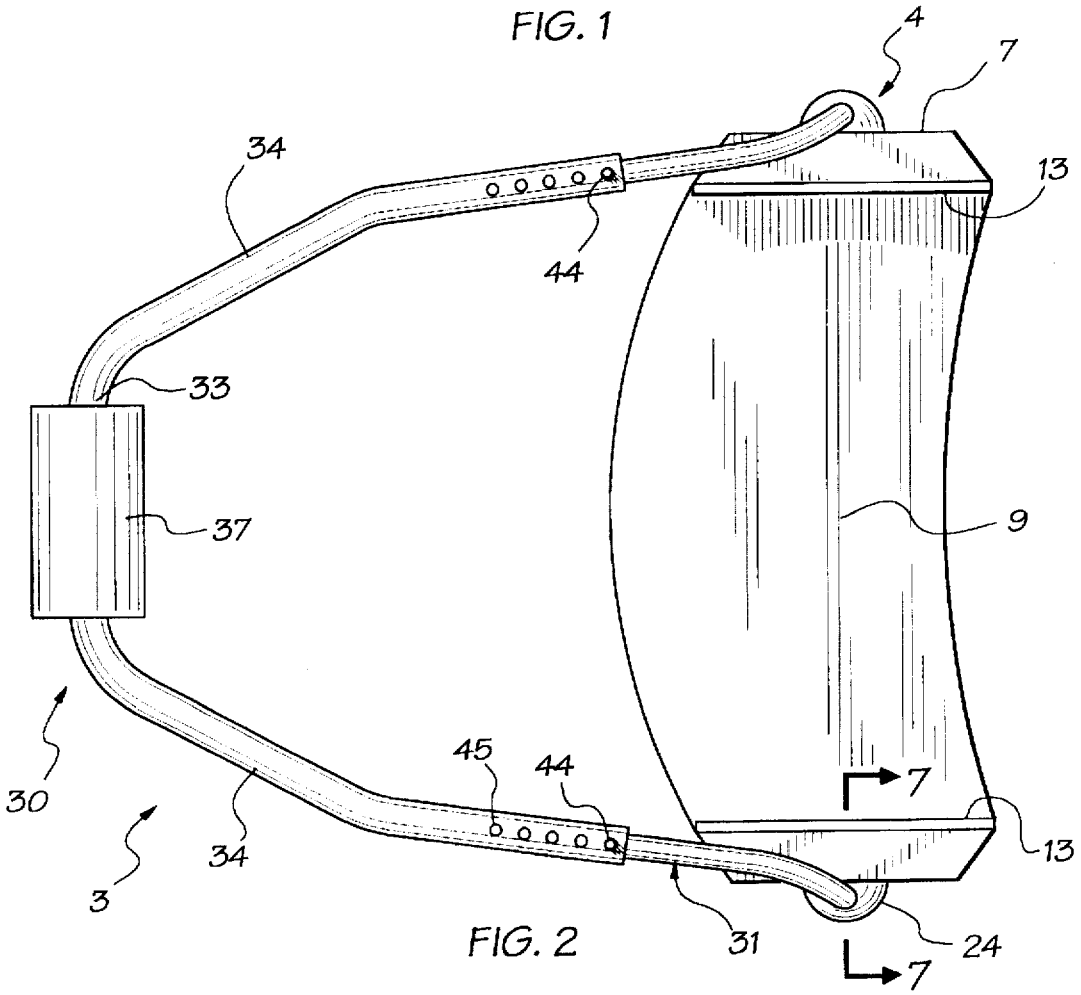
FIG. 2 is an enlarged top plan view of the exercise device of FIG. 1.
Figure 3:
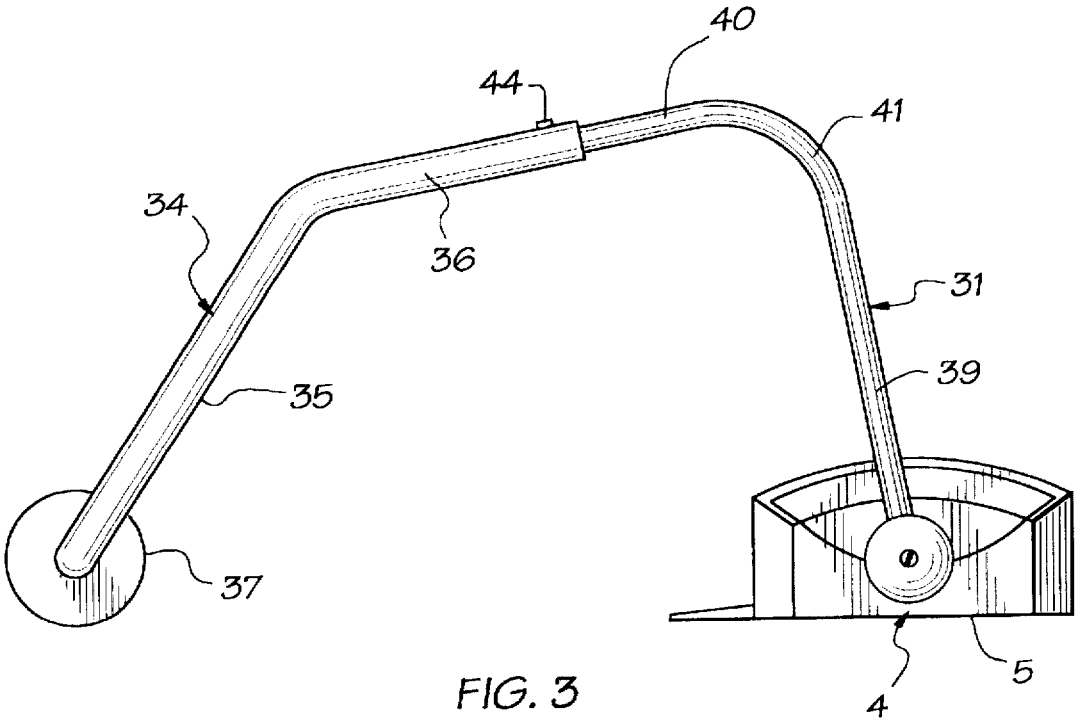
FIG. 3 is a side elevational view of the exercise device of FIG. 2.
Figure 9:
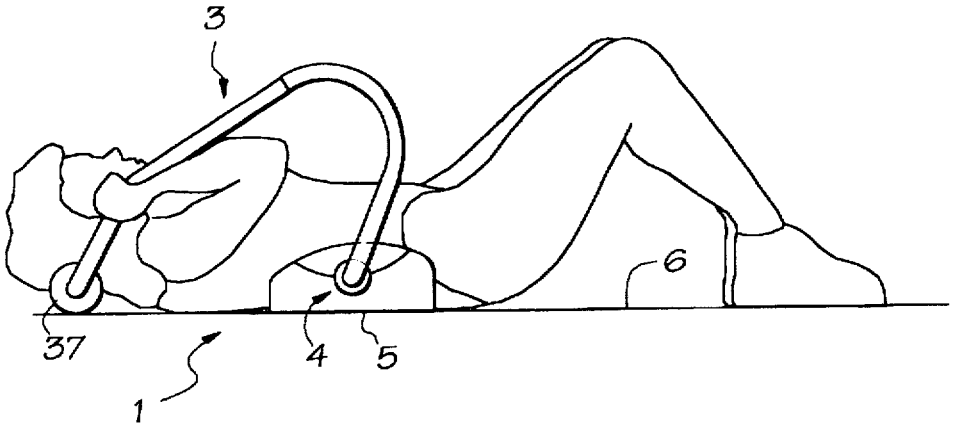
FIGS. 9 and 10 are diagrammatic side elevational views showing the manner of use of the exercise device of the present invention.
Figure 10:
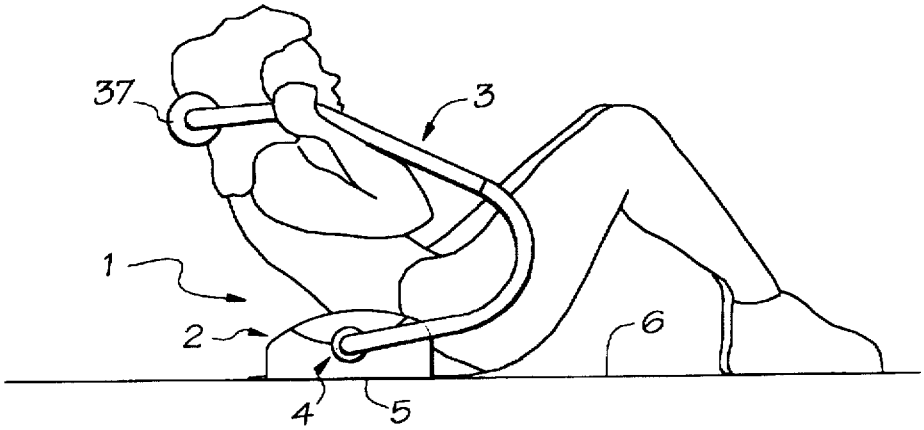

The exercise device of the present invention is indicated generally at 1, and is shown in FIGS. 1–3 in an assembled operable position. Device 1 includes a platform, indicated generally at 2, and a body cage, indicated generally at 3, which is pivotally connected to platform 2 by a pair of pivot mechanisms 4. Platform 2 is adapted to be placed in a fixed position on a flat support surface 6, as shown in FIGS. 9 and 10, and is intended to support the lower torso of a user.

Platform 2 includes a flat bottom 5 which contacts and supports the device on support surface 6, and further includes a pair of opposed parallel side walls 7, and an upper intervening support surface 8. Support surface 8 is substantially flat and may have a shallow concave central portion 9 which extends slightly inwardly from side walls 7 so as to conform generally with the curvature of the lower back of the user.

Figure 8:
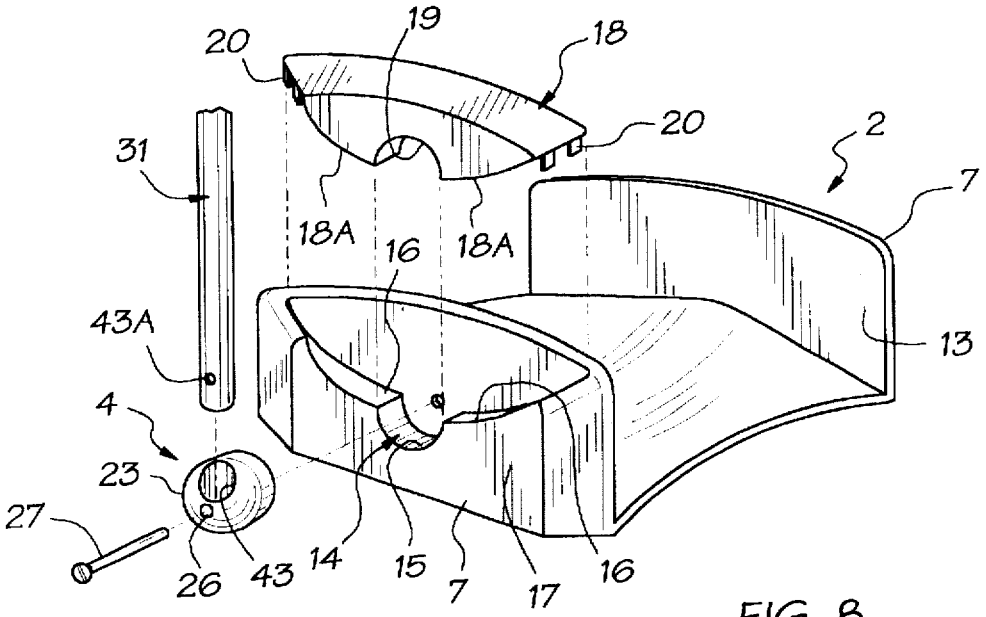
FIG. 8 is a fragmentary exploded perspective view of the platform and ball/socket pivot components of FIG. 1.

Side walls 7 may have various configurations, one of which is shown in the drawings and described below. Each side wall 7 preferably includes a substantially flat vertically extending inner wall 13 and a partial outer wall 17, which walls form a hollow interior 14 (FIG. 8). Outer wall 17 is formed with a semicircular recess 15 and a pair of upwardly curved edges 16. An upper wall portion, indicated generally at 18, is formed with a semicircular concave recess 19 and a plurality of snap-fit projections 20 which engage complementary-shaped recesses or projections (not shown) formed within the hollow interior of side walls 7 for securing upper wall portions 18 in position on side walls 7. Upper wall portions 18 are formed with curved bottom edges 18*a* which are complementary to the curvature of edges 16 of walls 7 so as to mate therewith when wall portions 18 are joined with walls 7.

Figure 5:
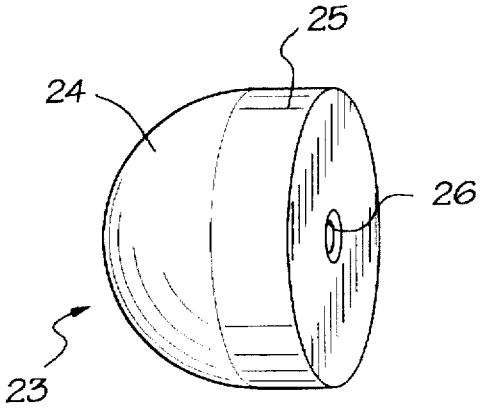
FIG. 5 is a rear perspective view of the pivot ball removed from the device, as shown in FIGS. 1–3.
Figure 6:
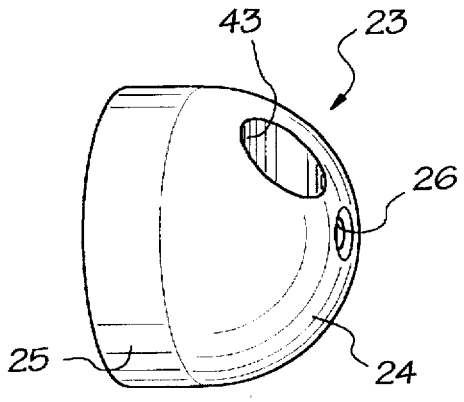
FIG. 6 is a front perspective view of the pivot ball of FIG. 5.

Pivot mechanism 4 includes a circular socket 21 formed in side wall 7 by aligned recesses 15 and 19, and a pivot ball, indicated generally at 23 and shown in FIGS. 5 and 6. Pivot ball 23 includes an outer semispherical portion 24 and an inner cylindrical portion 25, which portions form an integral one-piece member formed of a rigid plastic material. A through hole 26 (FIG. 7) is formed in pivot ball 23 and receives a fastening pin 27 therein. Hole 26 preferably has a countersunk outer end 28. Pin 27 extends into a blind hole 29 formed in wall 7 and secures pivot ball 23 within circular socket 21 in each of the platform side walls 7. If desired, pin 27 could extend completely through wall 7 and be secured by another type of fastener to side wall 7. Thus, cylindrical inner portion 25 of each pivot ball 23 is freely rotatable within a respective circular socket 21 to provide for the pivotal movement of cage 3, as discussed further below.

Cage 3 preferably is formed of a thin-wall lightweight aluminum or stainless steel tubing and includes a U-shaped head and neck portion, indicated generally at 30, and a pair of inclined connecting members 31. U-shaped support portion 30 includes a central section 33 and a pair of legs 34, each leg having an inclined section 35 and a linearly extending section 36 (FIG. 3). A padded cushion 37 preferably is mounted on central portion 33 to provide a comfortable support and rest for the head of a user, as shown in FIGS. 9 and 10.

Each of the inclined connecting members 31 includes a generally vertically extending section 39 and a linear, generally horizontally extending section 40, which form a substantially smooth curved right-angled corner 41 with section 39. The lower ends of inclined connecting members 31 are slidably received within a blind hole 43 (FIG. 7) formed in semispherical outer portion 24 of pivot ball 23, and are secured therein by pins 27 which extend through holes 43*a* formed in the free ends of connecting members 31.

In accordance with one of the features of the invention, U-shaped head and neck support portion 30 is adjustably mounted on connecting members 31 to permit the distance between support cushion 37 and platform 2 to be adjusted to match the particular size of an exerciser using device 1. One type of adjustment may be a pair of spring-biased detents 44 which are mounted on the end of a leaf spring (not shown) which is located in the outer end of each of the connecting members 31. Detents 44 are selectively received within selected ones of a plurality of holes 45 formed in the extended free ends of legs 34 of U-shaped support members 30. The spring-biased detents are merely one type of adjustment mechanism which can be utilized to adjust the size of body cage 3 for accommodating exercisers of various body sizes.

Figure 4:
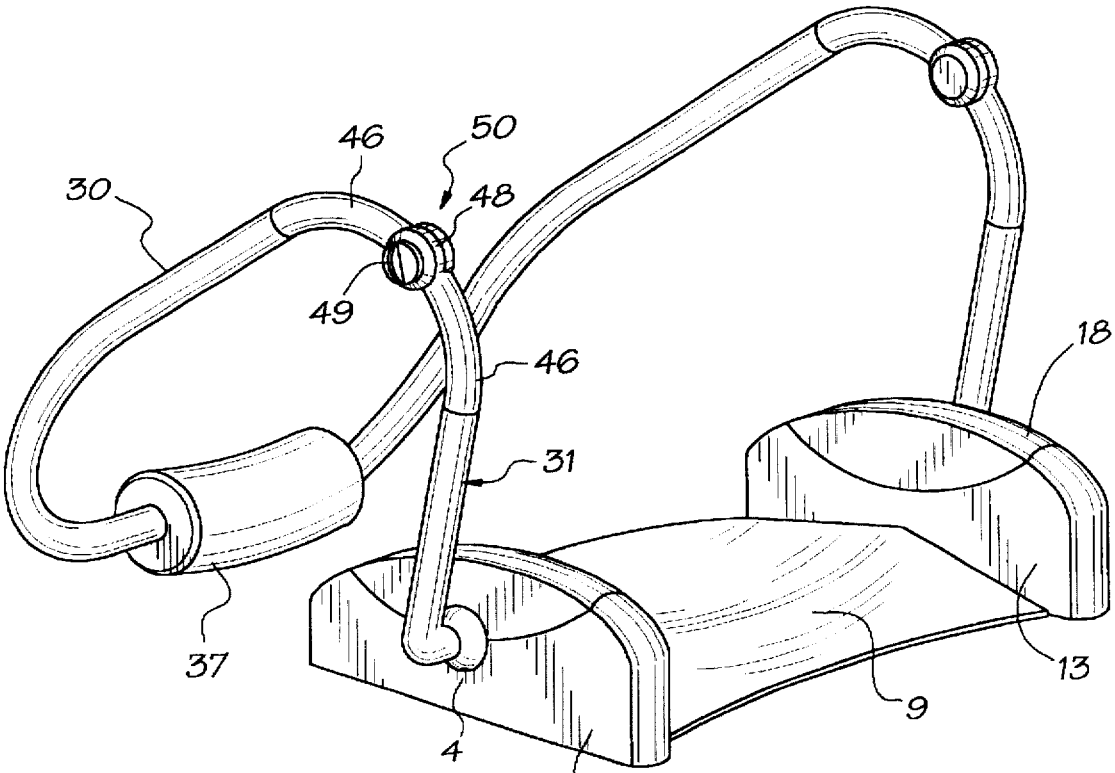
FIG. 4 is a perspective view similar to FIG. 1 of a modified embodiment of the exercise device shown in FIGS. 1–3.

FIG. 4 shows a modified type of adjusting mechanism, which is indicated generally at 50. Adjustment 50 includes a pair of tubular members 46, the outer ends of which are slidably received within the open ends of connecting members 31 and U-shaped head and neck support member 30. An adjustable pivot mechanism 48 is mounted between the inner ends of tubular members 46 for placing the members in a predetermined angular position where they are secured by a locking knob 49 once set by the particular exerciser. Again, other types of adjusting mechanisms than the spring-biased detents of FIGS. 1–3 and the adjustable pivot mechanism of FIG. 4 can be utilized.

FIGS. 9 and 10 show one manner in which device 1 can be utilized for performing a sit-up type of abdominal exercise, and its manner of use and the advantages achieved thereby are described below.

Basically, exercise device 1 of the present invention generally comprises upper body cage 3 which is pivotally mounted on substantially flat stable platform 2. More specifically, upper body cage 3 comprises left and right inclined upper sections 35 and linear sections 36 which are slidingly or rotatably connected to sections 40 of left and right lower connecting members 31. Members 31 include substantially vertically oriented sections 39 which pivotally connected to left and right lateral walls 7 of platform 2. The left and right inclined upper sections 35 of the upper body cage are connected proximally to form the substantially U-shaped neck support portion 30 having padded cushion 37 for comfortably supporting the weight of the user's head and neck. The left and right linear upper sections 36 are slidingly or rotatably connected to the left and right linear sections 40 so as to permit the device to be ideally positioned under the user to thereby accurately position the neck support and the stable platform specific to the body dimensions of the individual user and thus ensure a full range of motion of the exercise in an ideal plane of movement so as to maximally recruit the abdominal muscles.

The linear inclined sections 35 of the device of the present invention further provide a plurality of hand grasp positions whereby the user grasping the hands at the maximum inclination of linear sections 35 adjacent sections 36 of the upper portion of body cage 3, effectively reduces the user's mechanical advantage for lifting the body into the exercise range of motion. Conversely, grasping the sections 35 at the lowest point of inclination adjacent central portion 33, increases the user's mechanical advantage for lifting the body into the sit-up exercise range of motion. Thus, the user may, by varying the hand position along the length provided by the sections 35 of the upper body cage, progressively increase or decrease the resistance to the exercise. With the user's hands grasping further proximally, toward the user's head, a mechanical lift advantage is provided by the user's arm strength so as to assist the abdominal muscles in performance of the exercise. With the user's hand positioned progressively more distally along the length of sections 35 of the upper body cage, the potential for the user recruiting arm muscle strength to assist in the lift is reduced, thus focusing the lift demand to the abdominal musculature.

The neck support provided by portion 33 and cushion 37 effectively reduces stress to the anterior musculature of the neck. Conventionally, the sit-up exercise is performed with the user's hands clasped behind the neck to therefore prevent hyperextension of the neck and thus impingement of the sensitive cervical spine facet joints. However, with the hands clasped behind the user's neck, there is a tendency for the neck to be hyperflexed by the pulling forces of the user's arms. Hyperflexion of the neck increases loading on the cervical spine discs, predisposing the discs to excessive compression strain and thereby increasing the potential for disc rupture and herniation. Furthermore, hyperflexion of the neck places a long axis traction stress to the posterior cervical musculature and may result in muscular strain or sprain.

Upper body cage 3 extends from the neck support portion to the pivoting attachment at stable platform 2. The platform is ideally positioned under the user's body so as to locate the pivoting point of the upper cage assembly directly under the user's spine at the thoraco-lumbar junction. The thoraco-lumbar junction is defined as that area of the spine where the rib cage ends and the lumbar spine begins.

The abdominus rectus muscle and the internal and external oblique muscles, which constitute the abdominal wall, take their attachments at the front and lateral margins, respectively of the rib cage anteriorly and superiorly and at the front and lateral margins, respectively, of the pelvic bones anteriorly and inferiorly. It is desirable to effectively fix the body's movement above and below the area to be exercised, allowing the joint, or joints, over which the muscles act to move freely while reducing the potential for extraneous muscle recruitment which would assist in performing the work of the abdominal muscles desired to be isolated in the exercise.

Placement of the pivoting point between the upper cage and the platform at the thoraco-lumbar junction effectively eliminates the potential for extraneous body movement, and thus cheating of the exercise by recruitment of other muscular components. Also, by virtue of the rigidity of the upper cage assembly, the entire upper body and upper thoracic cage prohibits the user from using momentum of the upper body to overcome the inertia required to perform the lift from the fully supine exercise start position into the sit-up range of motion. Thus, the rigid upper cage and the placement of the pivot point at the thoraco-lumbar junction permits improved isolation of the abdominal musculature, ensures the movement is performed in the proper plane to effectively and maximally recruit the abdominal musculature during the exercise and eliminates the potential for cheating, restricting the recruitment of accessory muscle groups and eliminating the potential for the user to use momentum to overcome the inertia required to initiate the exercise movement.

Users have varying upper body length dimensions. Thus, it is necessary, in order to consistently position the pivot point under the thoraco-lumbar junction, while still maintaining an effective support to the user's neck anatomy, that the upper cage assembly include a means for selectively varying the distance between the neck support means and the pivot point. Thus, the upper cage includes an adjustment means to permit the selective adjustment and alignment of the neck support means and the pivot point specific to the user's anatomical requirement. This angle adjustment between the upper portion and lower portion of cage 3 permits the individual user to better isolate the abdominal musculature through fixation of the upper torso above the thoraco-lumbar junction of the spine, thus fixing the fulcrum of the movement at one attachment of the abdominal musculature.

The ball and socket pivot means permits a full and free range of motion of the sit-up exercise. To better isolate the oblique muscles of the abdominal wall, the user simply twists the lower limbs, knees and hips bent to approximately 90 degrees, to the left side of the body to thereby orient the right internal oblique and left external oblique muscles in the proper exercise plane. Twisting the lower limbs to the right side of the body, knees and hips bent to approximately 90 degrees orients the left internal oblique and right external oblique muscles in the proper exercise plane.

Further advantages of device 1 over prior art exercise devices intended for abdominal exercises is its relatively low cost and space savings for storage and shipment, in that cage 3 may be collapsed or removed for space saving and packaging advantages, and the lightweight portability thereof.

In addition to the usual abdominal sit-up exercises above, referred to as the abdominal crunch, oblique crunches also can be performed by the user bending the knees approximately 90 degrees and twisting to either the left or right side. Also, knee-up exercises can be performed, wherein the exerciser lies supine with hips and knees bent approximately 90 degrees and grasps along sections 35 of cage 3 and lifts the knees up and towards the torso.

Figure 7:
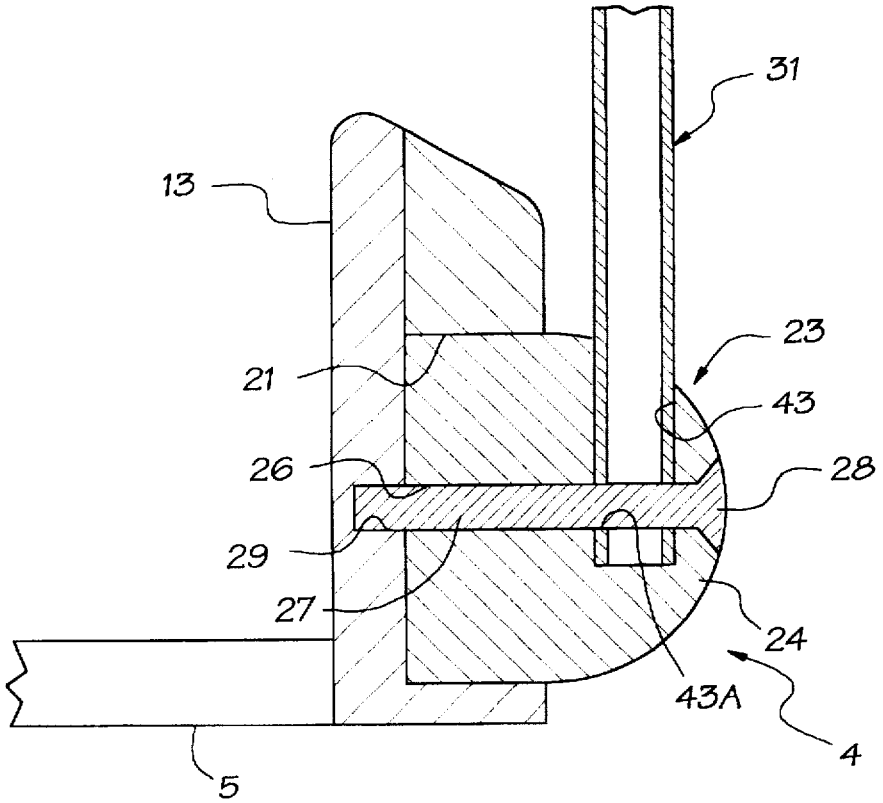
FIG. 7 is an enlarged fragmentary sectional view taken on line 7—7, FIG. 2.
Figure 11:
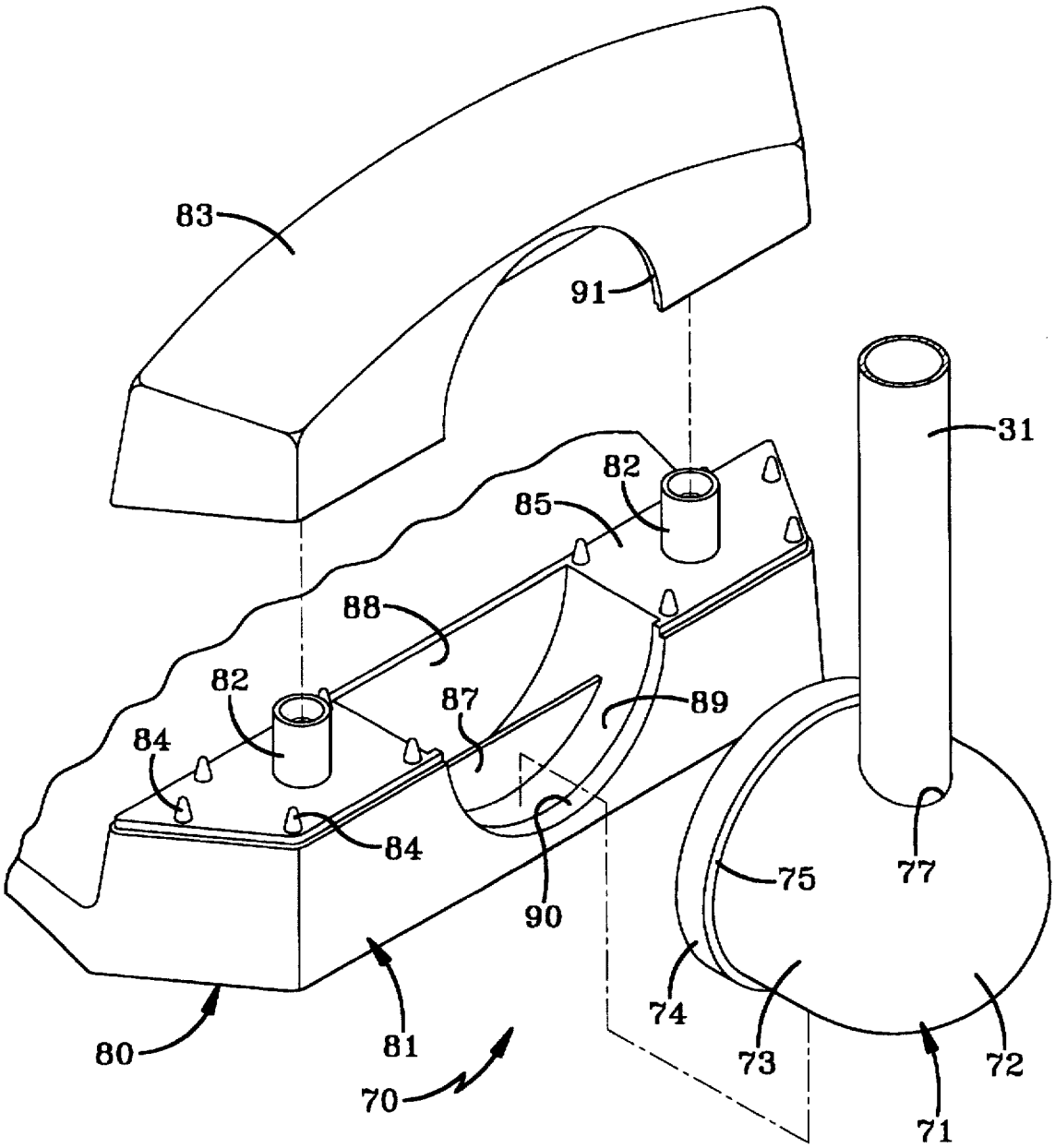
FIG. 11 is a fragmentary exploded view showing a modified pivotal mounting arrangement of the pivot ball and receiving socket.

FIGS. 11–12 show a pivot connection modified from that shown particularly in FIG. 7. The pivotal connection of FIGS. 11 and 12, which is indicated generally at 70, includes a pivot ball, indicated generally at 71, having a semispherical portion 72 which merges into a cylindrical portion 73 which terminates in an enlarged cylindrical end portion 74 which is connected to cylindrical portion 73 by a stepped shoulder 75. An opening 77 is formed in portion 72 for receiving free end 78 of body cage connecting member 31 therein, where it is secured by a threaded fastener 79.

Modified side wall 80 of platform 2 includes a generally trapezoidal-shaped lower wall portion or base 81 having a pair of cylindrical bosses 82 for securing an upper wall portion 83 thereon by a pair of bolts (not shown) which extend through bosses 82 and into threaded holes formed in upper wall portion 83. A plurality of nubs 84 are formed on a top wall 85 of lower wall portion 81, which are received within upper wall portion 83 to assist in stabilizing the two members in a secured position (FIG. 12).

A pair of semicircular inner and outer concave recesses 88 and 89 are formed in wall portion 81 and are separated by an upstanding wall 87, with the enlarged annular end 74 of ball 71 being rotatably mounted within outer recess 89 when top wall portion 83 is secured to bottom wall portion 81, as shown in FIG. 12. Curved edges 90 and 91 of lower and upper wall portions 81 and 83, trap stepped shoulder 75 therebetween, as shown in FIG. 12. Thus, outer concave recess 89 provides a smooth surface on which cylindrical end portion 74 of ball 71 slidably rotates and pivots when the body cage portion is being pivotally moved when performing an exercise.

FIG. 13 shows the use of an elastomeric sleeve 98 being mounted on the end of each of the connecting members 31 when they are slidably received within the respective hollow interior of legs 34, such as shown in FIGS. 1–3, to form a more stable connection therebetween, which is free of vibration.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved exercise device is constructed and used, the characteristics of the construction, and the advantageous, new and useful results obtained; the new and useful structures, devices, elements, arrangements, parts and combinations, are set forth in the appended claims.

We claim:

1. An abdominal exercise device, including:

a platform adapted to be placed on a support surface for supporting the lower torso of a user, said platform including an upper support surface and a pair of opposed sides and a pair of upstanding walls on said sides of the platform extending above the support surface and forming a recess therebetween;

a body cage for grasping by a user and providing head and neck support for the user during use of the device; and pivot means for pivotally attaching the body cage to the sides of the platform, whereby said platform remains in a fixed position on the support surface during pivotal movement of the body cage when the user is performing an abdominal sit-up exercise, said pivot means including a socket formed in each of the platform side walls and a pivot member rotatably mounted in each of said sockets, and in which each of the pivot members includes a cylindrical portion and a semispherical portion.

2. The exercise device defined in claim 1 in which the support surface has a generally concave central portion which extends between the walls.

3. The exercise device defined in claim 1 in which each of the pivot members is an integral one-piece member formed of a plastic material.

4. The exercise device defined in claim 1 in which each of the platform walls includes upper and lower sections; and in which each section is formed with a concave recess which align with each other and form the pivot socket.

5. The exercise device defined in claim 4 in which the cylindrical portion of each of the pivot members is rotatably mounted within the aligned recesses of the wall sections.

6. The exercise device defined in claim 1 in which each of the pivot members is formed with a hole; and in which an end of the body cage is secured within said holes.

7. The exercise device defined in claim 1 in which the body cage includes a U-shaped neck support portion and a pair of connecting portions extending between said neck support portion and the platform.

8. The exercise device defined in claim 7 in which a padded cushion is mounted on the U-shaped neck support portion a distance from the platform.

9. The exercise device defined in claim 8 in which the body cage includes adjustment means for adjusting the distance between the padded cushion and the platform.

10. The exercise device defined in claim 7 in which the neck support portion includes a pair of ends which telescopically fit with a first end of the connecting portions and are secured thereto with a detent pin mounted on one of the ends and a plurality of holes formed in the other end through which the detent pin extends.

11. An abdominal exercise device including: a body cage having a substantially U-shaped configuration with a pair of spaced side members for grasping by a user and an intervening member providing head and neck support for the user during use of the device, wherein the upper torso of the user is adapted to be located between said side members;

spaced-apart pivot means operatively connected to free ends of the body cage side members and located in a fixed position on a support member providing pivotal movement to the body cage;

pad means mounted on the intervening member for supporting the head and neck of a user located between said side members; and the support member includes spaced-apart side walls and pivot means formed on each of said side walls, said pivot means includes a ball and socket, said sockets being formed with concave recesses in the spaced-apart side walls and said balls being mounted on the free ends of the side members and formed with a cylindrical portion which is rotatably trapped with said concave recess of the socket.

12. The abdominal exercise device defined in claim 11 including adjustment means for changing the lengths of the side members of the body cage to change the spacing between the intervening member and the pivot means.

13. The abdominal exercise device defined in claim 12 in which the adjustment means includes a spring detent.

14. The abdominal exercise device defined in claim 11 in which a platform extends between the spaced-apart side walls for supporting a lower torso of the user when in a supine position between said side walls.

15. The abdominal exercise device defined in claim 11 in which the cage is formed of hollow metal tubing.

* * * * *